United States Patent [19]

Wüst

[11] Patent Number: 4,552,320

[45] Date of Patent: Nov. 12, 1985

[54] METHOD AND APPARATUS FOR FORMING SNARL-FREE THREAD RESERVES

[75] Inventor: Olivier Wüst, Seuzach, Switzerland

[73] Assignee: Maschinenfabrik Schrärer AG, Erlenbach, Switzerland

[21] Appl. No.: 482,037

[22] Filed: Apr. 4, 1983

[30] Foreign Application Priority Data

Apr. 20, 1982 [CH] Switzerland ..... 2373/82
Sep. 29, 1982 [CH] Switzerland ..... 5772/82

[51] Int. Cl.[4] ..... B65H 49/00; B65H 69/04
[52] U.S. Cl. ..... 242/128; 57/354
[58] Field of Search ..... 242/35.6 R–37 R, 242/46, 47, 54 R, 128, 140, 157 R, 129, 8; 57/73, 353–356, 357

[56] References Cited

U.S. PATENT DOCUMENTS 3,057,577 10/1962 Ruhl ..... 242/128
3,099,418 7/1963 Schustack ..... 242/129.8
3,124,316 3/1964 O'Brien et al. ..... 242/35.5 R
3,343,361 9/1967 Würmli ..... 57/73
3,648,940 3/1972 Meredith ..... 242/54 R
3,823,539 7/1974 Hart ..... 57/73

*Primary Examiner*—Leonard D. Christian
*Attorney, Agent, or Firm*—Werner W. Kleeman

[57] ABSTRACT

Snarls are formed at winding machines and the like when the thread tension is reduced. By reducing the angle $\alpha$ which the thread forms with the end surface or face of the delivery bobbin or spool the friction between the thread and the bobbin edge can be increased to such an extent that no thread coils or turns can disengage from the surface of the delivery bobbin and become snarled even when the thread tension decreases. The reduction in the angle $\alpha$ may be achieved by lowering a thread guide eye towards the delivery bobbin, by lifting the delivery bobbin or by deflecting the thread at an extension or protection provided at the bobbin. Upon deflecting the thread at the extension a thread reserve can be provided by applying thread turns at the extension in a direction opposite to the thread turns wound on the bobbin and which thread reserve can be eliminated in a simple manner by withdrawing the same as a whole or in sections.

26 Claims, 11 Drawing Figures

METHOD AND APPARATUS FOR FORMING SNARL-FREE THREAD RESERVES

BACKGROUND OF THE INVENTION

The present invention relates to a new and improved method for forming a snarl-free thread reserve as well as to an improved winding machine or winder for winding-up one or a number of threads or the like.

In winding machines, twisting machines and doubling machines or frames the threads are withdrawn so-to-speak overhead from an unwinding or delivery bobbin or spool. The threads are guided by a guide eye or eyelet which is arranged above the unwinding or delivery bobbin. Due to the centrifugal forces acting upon the thread when it is running between the guide eye and the surface of the delivery bobbin the thread revolvingly travels in the form of a thread balloon. The guide eye is arranged at a distance from the surface of the delivery bobbin which is determined by experience and by the available space.

During re-piecing the threads after a thread rupture or after a bobbin exchange operation the length of thread required for the re-piecing operation is firstly withdrawn from the delivery bobbin. When the thread withdrawal step is terminated, and thus, the tension of the thread decreases, snarls form in the case of spun yarns which may result in knots which cannot be disentangled. Such knots cause irregularities like, for example, thick locations, which may cause needle breakage in sewing machines. Therefore, the thick locations must be removed during an additional operational step if an unobjectionable or faultless yarn is to be produced.

In case of interruptions in the working operations, i.e. whenever the running-off thread is not continuously led away or withdrawn from the delivery bobbin and if thus no tension acts upon the thread, then parts of the thread coils or turns or whole thread coils or turns may disengage from the surface of the bobbin and form snarls due to the twist originating from the spinning or twisting operation. Upon restarting it may happen, that the snarls do not unravel and are thus introduced into the winding operation. Also, knots can be formed which cause a new interruption at the winding location or may result in an interruption during further processing of the bobbin or the thread, respectively.

Various methods and apparatuses are known which strive to prevent snarl formation. One of the known apparatuses comprises a velour cushion arranged outside the thread balloon region. After withdrawal of the required thread reserve the operator fixedly retains the thread end with one hand and leads the thread coming from the bobbin to the cushion and presses the same against the latter with the other hand. No snarls now form between the bobbin and the cushion provided that the thread extends tangentially from the bobbin. The length of thread which can be obtained in this manner is very modest and will already become disengaged from the cushion when subjected to even the slightest pull or tension.

Also, clamping devices are already known which serve to retain the thread. However, also such clamping devices are unsatisfactory since for inserting the thread the operator first must open the clamping device and thus requires both hands for the operation.

Another apparatus for preventing threads snarls forming in running or travelling yarns as known, for example, from German Patent Publication No. 3,120,430, comprises a brush ring placed intermediate the yarn unwinding or delivery bobbin and a yarn guiding element. The elastic bristles of the brush ring project into the thread balloon and maintain the unwinding yarn taut.

The aforementioned device is totally unsatisfactory for use with fine yarns, and particularly with doubling machines, since the balloon is not freely formed, and thus, the yarn cannot run-off neatly from the surface of the bobbin. Furthermore, an automatic start-up of the machine is not possible without additional thread guiding means which hold the yarn disengaged from the brush ring.

SUMMARY OF THE INVENTION

Therefore, with the foregoing in mind it is a primary object of the present invention to prevent the formation of thread snarls and the disengagement of the thread coils or turns from the bobbin surface when the winding operation is interrupted at the winding location.

Another important object of the present invention is directed to preventing the formation of thread snarls at the unruptured thread or threads of doubling machines containing a multitude of threads travelling towards a take-up or winding bobbin.

Still a further significant object of the present invention is directed to a new and improved method for forming snarl-free thread reserves and a thread-winding machine which enables the formation of a snarl-free thread reserve in case of thread rupture through the use of a simple, one-handed procedure.

Yet a further significant object of the present invention is directed to forming snarl-free thread reserves from threads withdrawn overhead as well as from threads withdrawn tangentially from rotating bobbins or the like.

Another noteworthy object of the present invention is directed to a new and improved method and apparatus for forming snarl-free thread reserves.

Another specific object of the present invention aims at the provision of a new and improved method and apparatus for forming snarl-free thread reserves when encountering interruptions in the working operations.

Now in order to implement these and still further objects of the invention, which will become more readily apparent as the description proceeds, the method for forming thread reserves and for preventing snarls in the thread reserve between a delivery bobbin and a wind-up bobbin when there occur work interruptions and upon rupture of a thread at a winding machine, which thread is withdrawn while forming a balloon, is manifested by the features that, the thread which extends between a guide eye arranged above the delivery bobbin and limiting the balloon and the surface of the bobbin is deflected at the top edge of the bobbin such that, due to the friction at such top edge, the thread no longer can disengage from the bobbin surface when the thread tension slackens or decreases.

The thread-winding machine or the like of the present development is of the type comprising a mounting or donning mandrel for donning thereon a delivery bobbin. A driven wind-up bobbin serves to wind-up one or a number of threads or the like travelling to the wind-up bobbin. A guide eye or eyelet is arranged essentially coaxially with respect to the mounting or donning mandrel. Importantly, the invention contemplates the provision of means for reducing the angle formed by the thread extending between the guide eye and the delivery bobbin.

The deflection of the thread section or portion which runs from the unwinding or delivery bobbin to the winding or wind-up bobbin at the top edge of the delivery bobbin and the braking effect thus achieved effectively prevent the thread from performing any displacement towards the delivery bobbin surface and from forming, on the one hand, thread snarls at the delivery bobbin surface and, on the other hand, from sliding-off in the form of entire thread coils or turns from the delivery bobbin surface. By reducing the distance between the guide eye and the top or upper edge of the delivery bobbin or, respectively, by reducing the thread running or travel angle formed with the end face of the delivery bobbin, the friction of the thread at the top edge can be increased so that the thread no longer can slide back onto the surface of the delivery bobbin.

A further advantage of the invention is that the displacement of the guide eye and/or the delivery bobbin or spool can be accomplished with a modest expenditure in equipment.

A thread reserve can be readily manually withdrawn from the delivery bobbin even in the presence of a reduced distance between the guide eye and the delivery bobbin.

A thread reserve which is manually placed around an extension or projection of the delivery bobbin or its donning mandrel and which is secured by friction at the delivery bobbin edge can be achieved with a modest expense both at new as well as at existing machines.

It is a further advantage of the invention that the thread reserve can be eliminated by exerting a small tensioning force upon the thread.

According to a further advantage of the invention, the thread reserve can be applied to threads which are withdrawn overhead as well as to threads which are tangentially withdrawn.

It is a further advantage of the invention that the thread reserve even can be formed at the bobbin tube or sleeve.

A further advantage of the invention is that the thread reserve can be formed at the donning or mounting mandrel on which the delivery bobbin is mounted or donned.

It is a further advantage of the invention that no elements interfering with the machine handling need to be provided within the region of the thread travel.

A further advantage of the invention is that the thread reserve can be eliminated in a number of steps or stages.

According to a further advantage of the invention, the thread reserves can be laid with right-hand and left-hand spooled or wound threads.

It is a further advantage of the invention that, upon rupture of one of the threads during a doubling operation or the like, the unruptured thread or threads also can be laid to form a thread reserve loop, and thus, do not have to be re-pieced.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Describing now the drawings, it is to be understood that only enough of the construction of the thread-winding machine has been shown as needed for those skilled in the art to readily understand the underlying principles and concepts of the present development, while simplifying the showing of the drawings. Also, in the context of this disclosure and the appended claims the term "thread" is used in its broader sense to also encompass yarns and like filamentary materials.

Figure 1A:
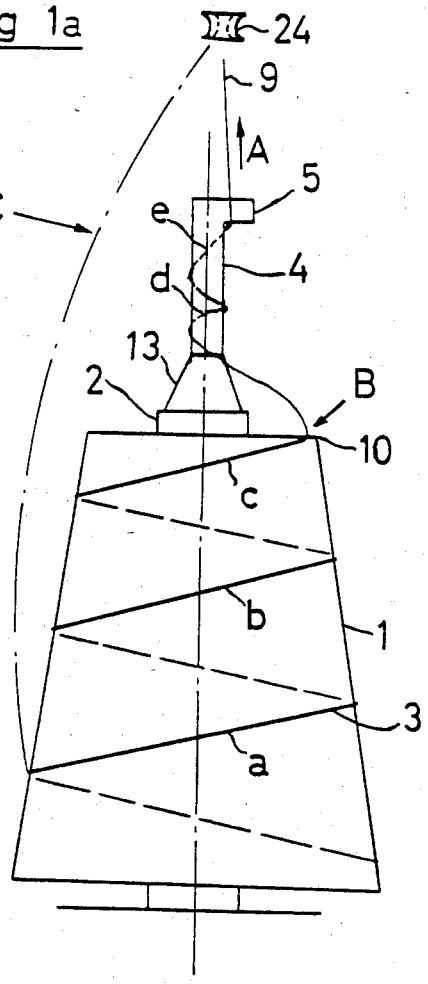
FIG. 1*a* is a front view of a bobbin mounted or donned on a mandrel of a thread-winding machine constructed according to the invention, in which the thread is withdrawn overhead.

Turning attention now specifically to FIG. 1*a,* there has been schematically illustrated therein a delivery bobbin or spool 1 which is mounted on a suitable mounting or donning mandrel not particularly visible in such Figure. The mounting or donning mandrel extends into the bobbin tube or sleeve 2 of the delivery bobbin 1 and such delivery bobbin is held thereon so as to be non-rotatable relative thereto. A multitude of thread coils or turns lie on the delivery bobbin 1, of which only three are shown, which have been individually designated by reference characters a, b, c. Together all of the thread coils or turns form the thread or thread package 3.

Figure 1B:
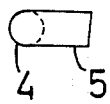
FIG. 1*b* is a top plan view of the end of the donning mandrel shown in FIG. 1*a;*
Figure 2A:
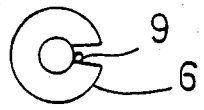
FIG. 2*a* is a top plan view of the end of the donning or mounting mandrel shown in FIG. 2*b;*
Figure 2B:
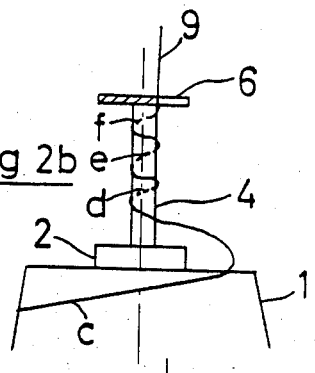
FIG. 2*b* is a fragmentary view, similar to the showing of FIG. 1, of the end region of a modified construction of donning or mounting mandrel.
Figure 3:
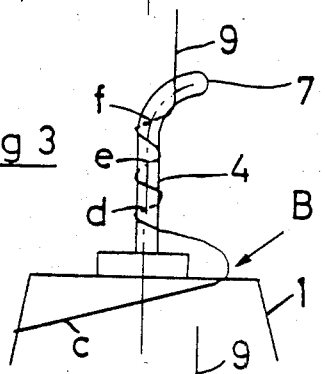
FIGS. 3 and 4 respectively show the ends of modified mandrels in a view similar to the view depicted in FIG. 1.

From the top or upper end or head of the delivery bobbin 1 or the tube 2, respectively, there projects an extension or projection 4 containing a bent or flexed end member 5, see FIG. 1*b.* Instead of the flexed end member 5 there also could be provided a slotted disk 6 as shown in FIGS. 2*a* and 2*b,* or else the extension or projection 4 may comprise a goose-neck member 7 as shown in FIG. 3, or may comprise a piece of wire or the like.

Figure 4:
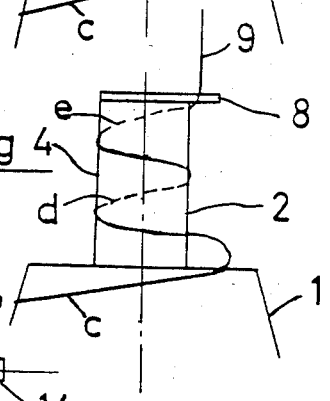

Instead of the extension or projection 4, the bobbin tube or sleeve 2 of the delivery bobbin 1 as such may be extended by several centimeters, see FIG. 4, and may comprise an end member 8 similar to the end member 6 shown in FIG. 2*a.* In all the different embodiments a conical section or portion 13 may be provided at the base of the extension 4, see FIG. 1*a*.

Preferably, the surface of the extension or projection 4 is polished to prevent the thread from becoming damaged during its withdrawal and to ensure that the thread will slide thereon with the smallest resistance.

The formation of the thread reserve will be now described hereinafter:

The thread end 9, for example, may measure in length 20 cm and follows the last thread coil or turn c; it is wound once or a number of times around the extension 4 and guided upwardly in the direction of the arrow A. The thread reserve is now deflected in a snarl-proof fashion at the top or upper edge 10 of the delivery bobbin 1, and such thread reserve adheringly lies at the surface of the delivery bobbin 1 and is easily eliminated. In the example illustrated in FIG. 1*a*, the thread reserve is composed of the length of the two thread turns b and c on the delivery bobbin 1 and the length of the two thread turns d and e on the extension or projection 4.

Upon withdrawing or eliminating the thread reserve by pulling at the thread end 9 the thread loop B slides along the top edge 10 and is braked thereat due to friction. The flexed end member 5 prevents the thread i.e., the turns e and d from sliding-off the extension 4 prior to elimination thereof.

During each complete revolution of the thread loop B at the top edge 10 one respective thread coil or turn on the delivery bobbin 1 and on the extension 4 are eliminated. When all thread turns d and e on the extension 4 have been eliminated the thread will automatically slide-off the end member 5 at which it has been retained up to this point in time and then forms the balloon-shaped thread run or balloon C.

Thus the length of the thread reserve is dependent upon two factors: on the one hand, it depends upon the number of thread coils or turns laid on the extension or projection 4 and, on the other hand, upon the instantaneous or momentary diameter of the delivery bobbin 1 which determines the length of the thread turns a, b and c.

As long as a thread loop B or, respectively, a thread coil or turn is present on the extension 4, the thread tension effective at the thread end 9 may decrease or slacken at any time without a snarl being able to form in the thread reserve on the surface of the delivery bobbin 1.

Figure 5:
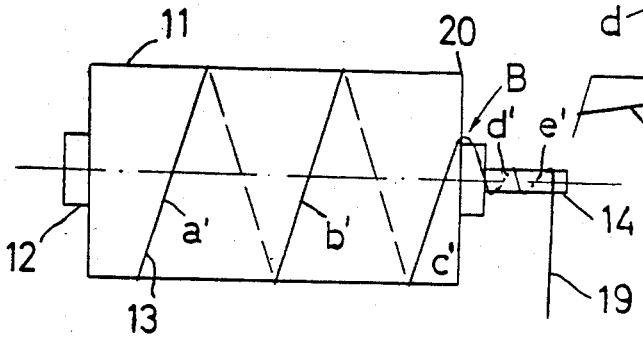
FIG. 5 is a view of a delivery bobbin mounted on a mandrel of the thread-winding machine according to the invention in which the thread is tangentially withdrawn.

Analogously in FIG. 5 a thread 13 is illustrated which is withdrawn tangentially from a delivery bobbin 11. Two thread turns d' and e' are laid on an extension or projection 14. The thread loop B formed by the thread end 19 which leads to the thread coils or turns a', b' and c' slides at the top edge 20. Due to the tangential withdrawal of the thread end 19 the attachment of an end member to the extension or projection 14 can be dispensed with.

On withdrawing or, respectively, eliminating the thread reserve one turn on the delivery bobbin is eliminated for each turn on the extension or projection 14.

The extensions or projections 4, 14 may be designed as an extension or projection of the mounting mandrel, however, may also form independent elements inserted into the bobbin tube or sleeve 2 or 12, respectively.

The only condition for the undisturbed withdrawal of the thread 3 is that the extension or projection 4 including the end members 5, 6, 7 or 8 have to be disposed within the balloon C formed by the thread. In the embodiment shown in FIG. 5 in which the delivery bobbin 11 rotates during operation, the design of the extension or projection 14 is only of secondary importance.

Figure 6:
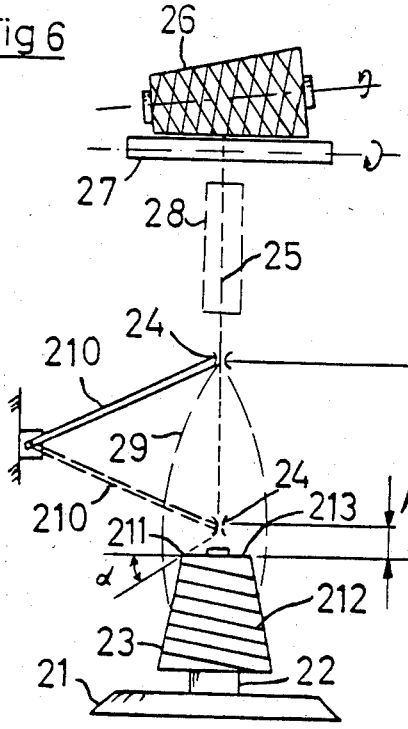
FIG. 6 is a schematic illustration of a winding location including a displaceable guide eye or eyelet in a thread-winding machine constructed according to the invention.
Figure 7:
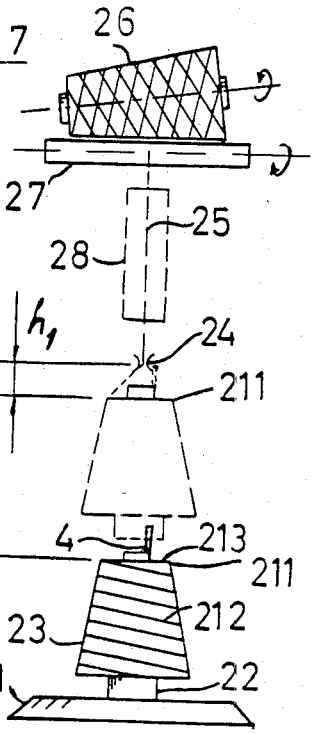
FIG. 7 is a schematic illustration of a winding location including a displaceable delivery bobbin mounting arrangement in a thread-winding machine constructed according to the invention.

Details of the winding locations or stations are shown in FIGS. 6 and 7 only to such extent as required for understanding the principles of the invention. Particularly, to enhance the illustration all driving and control elements or means as well as the supporting structure and the adjacent winding locations have been conveniently omitted.

At a bobbin creel 21 containing a mounting or donning mandrel 22 an unwinding or delivery bobbin 23 is mounted in vertical position. The bobbin creel 21 may be fixedly connected to a supporting structure or may be pivotably or rotatably mounted thereto. A guide eye or eyelet 24 or like guide element extends coaxially with respect to the bobbin donning mandrel 22 and is located at a distance $h_o$ from the unwinding or delivery bobbin 23. A thread 25 withdrawn from the unwinding or delivery bobbin 23 extends through the guide eye 24 to a winding or wind-up bobbin or spool 26 which, for example, is driven by means of a friction drum or roll 27. A suitable thread laying or depositing apparatus (not shown) guides the thread 25 back-and-forth with a traversing motion along the winding bobbin 26 in order to form cross-wound turns thereon, i.e., to form a cross-wound thread package as is well known in this technology. The rectangle 28 shown in broken lines schematically represents a suitable thread monitoring means or monitor, a thread separating or cutting and splicing means as well as an optionally present automatic thread attaching or piecing means.

During withdrawal the thread 25 forms a revolving thread balloon 29 intermediate the delivery bobbin 23 and the guide eye 24. Consequently, the thread 25 runs directly from the outer surface of the delivery bobbin 23 to the guide eye 24 without contacting the edge 211 of the delivery bobbin 23.

According to FIG. 6, the guide eye or thread guide 24 is mounted at an arm 210 by means of which it is pivotable from a working position shown in full lines into a rest position shown in broken lines. In the rest position the distance $h_o$ between the guide eye 24 and the delivery bobbin 23 is reduced to a fraction of the original value, here indicated by the distance $h_1$.

At the reduced distance $h_1$ the thread 25 forms an angle of $\alpha < 60°$ with the end face or surface 213 of the delivery bobbin 23; the thread is deflected or, respectively, braked by the top or upper edge of the delivery bobbin 23. Preferably, the angle $\alpha$ of the thread 25 is in the range of about 35° to about 55°, i.e. $45° \pm 10°$.

In the embodiment shown in FIG. 7 the deflection of the thread 25 or, respectively, the reduction of the distance $h_o$ to a value $h_1$ is achieved by arranging the creel 21 or, however, the donning mandrel 22 so as to be axially displaceable towards the guide eye or eyelet 24.

Pivoting of the support or mounting arm 210 or, respectively, displacement of the donning mandrel 22 may be done mechanically or pneumatically. The selection of the drive system will depend upon the kind of drive means already present at the machine.

It will be self-evident that the donning mandrel 22 and the guide eye 24 also may be positioned on an axis which is inclined to the vertical or extends horizontally.

Figure 8:
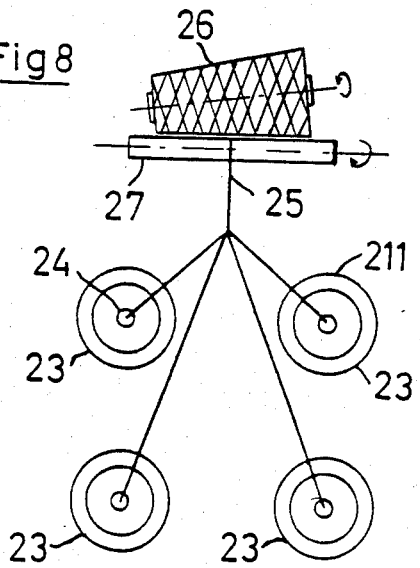
FIG. 8 is a front view of a winding location or station including four horizontally positioned delivery bobbins.
Figure 9:
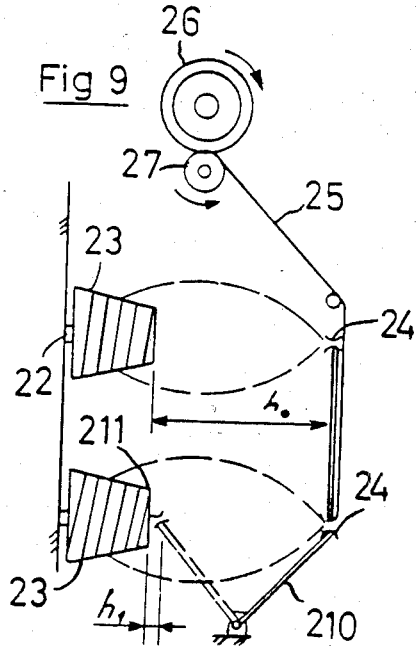
FIG. 9 is a side view of the arrangement shown in FIG. 8.

FIGS. 8 and 9 show horizontal mounting or donning means for the delivery bobbins, for example, of a doubling machine including four unwinding or delivery bobbins.

In case of thread rupture during operation or, respectively, shut-down of one winding location or station, then the machine control will cause, for example, after receiving a signal from the thread monitoring means 28, the arm 210 to be pivoted and/or the donning mandrel 22 to be displaced so as to reduce the distance between the guide eye 24 and the delivery bobbin 23 to the amount $h_1$. Consequently, the thread 25 will be deflected at the edge 211 of the delivery bobbin 23 and the friction at the edge 211 is increased. Due to the friction of the thread 25 at the edge 211 the thread coils or turns 212 lying on the upper surface no longer can be released from the delivery bobbin 23. Thus, snarl formation is precluded on the surface of the delivery bobbin 23 as well as in the remaining run of the thread 25.

With the guide eye 24 in the lowered position or the delivery bobbin 23 in the elevated position the tension effective at the thread 25 will reach a value at which the thread breaks at high withdrawal rates. In case that the lowering of the guide eye 24 or, respectively, the decrease of the angle $\alpha$ is effected in the non-broken or unruptured state of the thread 25, then the velocity at which the distance $h_o$ between the guide eye 24 and the delivery bobbin 23 is reduced will have to be adapted to the momentarily prevailing thread withdrawal rate.

The same conditions apply upon restarting the machine. The distance $h_1$ will have to be increased as the thread withdrawal rate increases.

Irrespective of the distance $h_1$ between the guide eye 24 and the unwinding or delivery bobbin 23, the thread length required, however, for re-piecing in the case of thread rupture can be manually withdrawn from the delivery bobbin 23 by overcoming the friction and, for example, in the case of thread rupture, can be drawn in anew.

In case that an extension or projection 4 is provided above the delivery bobbin 23 and is placed outside the bobbin axis thereof, the end member preventing the thread 25 from axial escape may be dispensed with when the end of the extension or projection 4 and the guide eye 24 are moved to the same level or elevational position after thread rupture.

While there are shown and described present preferred embodiments of the invention, it is to be distinctly understood that the invention is not limited thereto, but may be otherwise variously embodied and practiced within the scope of the following claims. Accordingly,

What I claim is:

1. A method for forming a thread reserve between a delivery bobbin and a winding bobbin and for preventing snarl formation in the thread reserve during re-piecing a thread in case of work interruptions or thread rupture of a thread withdrawn from the delivery bobbin while forming a thread balloon at winding machines, doubling machines or the like, comprising the steps of:

passing the thread from the delivery bobbin through a guide eye arranged above the delivery bobbin to said winding bobbin so as to form a thread balloon limited by the guide eye during the winding operation; and deflecting, in the event of a slackening in thread tension, said thread at an upper edge of said delivery bobbin and thereby continuously maintaining said thread in frictional engagement with said upper edge of said delivery bobbin substantially during the time of said slackening in the thread tension, whereby said thread is prevented from disengaging from an outer surface of the delivery bobbin due to the frictional engagement of said thread with said upper edge of said delivery bobbin.

2. A method for forming a thread reserve between a delivery bobbin and a winding bobbin and for preventing snarl formation in the thread reserve during re-piecing a thread in case of work interruptions or thread rupture of a thread withdrawn from the delivery bobbin while forming a thread balloon at winding machines, doubling machines or the like, comprising the steps of:

passing the thread from the delivery bobbin through a guide eye arranged above the delivery bobbin to said winding bobbin so as to form a thread balloon limited by the guide eye during the winding operation;

deflecting said thread at an upper edge of said delivery bobbin such that said thread is prevented from disengaging from an outer surface of the delivery bobbin due to friction at said upper edge in the event tension of the thread slackens; and reducing the distance between said guide eye and said delivery bobbin in the event of thread rupture or work interruption to such an extent that said thread extending between said upper edge of said delivery bobbin and said guide eye forms an angle of $<60°$ with an end surface of the delivery bobbin.

3. The method as defined in claim 2, wherein:

said thread extending between said upper edge of said delivery bobbin and said guide eye forms an angle in the range of 35° to 55° with said end surface of the delivery bobbin.

4. A method for forming a thread reserve between a delivery bobbin and a winding bobbin and for preventing snarl formation in the thread reserve during re-piecing a thread in case of work interruptions or thread rupture of a thread withdrawn from the delivery bobbin while forming a thread balloon at winding machines, doubling machines or the like, comprising the steps of:

passing the thread from the delivery bobbin through a guide eye arranged above the delivery bobbin to said winding bobbin so as to form a thread balloon limited by the guide eye during the winding operation;

deflecting said thread at an upper edge of said delivery bobbin such that said thread is prevented from disengaging from an outer surface of the delivery bobbin due to friction at said upper edge in the event tension of the thread slackens;

providing an axial extension at the region of said delivery bobbin;

forming upon said axial extension a thread turn from an end of the thread and which thread turn extends in opposition to the direction of wrap of the thread turns formed on said delivery bobbin; and forming a loop at said upper edge of said delivery bobbin from said thread turn on the axial extension in order to form a snarl-free thread reserve.

5. The method as defined in claim 4, further including the steps of:

braking said loop during withdrawal of said thread reserve by sliding the same along said upper edge of said delivery bobbin.

6. The method as defined in claim 4, further including the steps of:

after consuming the thread reserve preventing the end of the thread from axially sliding over an end of said extension.

7. The method as defined in claim 4, further including the steps of:

using the guide eye to prevent the thread from sliding over an end of said extension.

8. A winding machine or the like comprising:

a donning mandrel;

a delivery bobbin mounted on said donning mandrel;

a winding bobbin for winding-up one or a number of threads running towards the same;

drive means for driving said winding bobbin;

a thread guide arranged substantially coaxially with respect to and at a distance from said donning mandrel; and means for reducing, in the event of a slackening in thread tension, the angle formed by a thread which extends between said delivery bobbin and said thread guide, and an upper edge of said delivery bobbin such that said thread is deflected at said upper edge of said delivery bobbin and thereby is continuously maintained in frictional engagement with said upper edge of said delivery bobbin substantially during the time of the slackening in the thread tension and thus is prevented from disengagement from an outer surface of said delivery bobbin due to said frictional engagement with said upper edge of said delivery bobbin.

9. A winding machine or the like comprising:

a donning mandrel;

a delivery bobbin mounted on said donning mandrel;

a winding bobbin for winding-up one or a number of threads running towards the same;

drive means for driving said winding bobbin;

a thread guide arranged substantially coaxially with respect to and at a distance from said donning mandrel;

means for reducing the angle of a thread extending between said delivery bobbin and said thread guide; and said means for reducing said angle comprising structure for enabling lowering of the thread guide towards said delivery bobbin.

10. A winding machine or the like comprising:

a donning mandrel;

a delivery bobbin mounted on said donning mandrel;

a winding bobbin for winding-up one or a number of threads running towards the same;

drive means for driving said winding bobbin;

a thread guide arranged substantially coaxially with respect to and at a distance from said donning mandrel;

means for reducing the angle of a thread extending between said delivery bobbin and said thread guide; and said means for reducing the angle comprising structure for raising the delivery bobbin towards said thread guide.

11. A winding machine or the like comprising:

a donning mandrel;

a delivery bobbin mounted on said donning mandrel;

a winding bobbin for winding-up one or a number of threads running towards the same;

drive means for driving said winding bobbin;

a thread guide arranged substantially coaxially with respect to and at a distance from said donning mandrel;

means for reducing the angle of a thread extending between said delivery bobbin and said thread guide; and said means for reducing the angle comprising structure for reducing the distance between said thread guide and said delivery bobbin to such an extent that said angle is $<60°$.

12. The winding machine as defined in claim 9, wherein:

said structure for enabling lowering of the thread guide comprises a pivotable arm pivotable towards said delivery bobbin; and said thread guide comprising a guide eye mounted on said pivotable arm.

13. The winding machine as defined in claim 12, wherein:

said structure further included means for pivoting said pivot arm.

14. The winding machine as defined in claim 10, wherein:

said structure for raising the delivery bobbin comprises drive means for lifting said donning mandrel carrying said delivery bobbin.

15. A winding machine or the like comprising:

a donning mandrel;

a delivery bobbin mounted on said donning mandrel;

a winding bobbin for winding-up one or a number of threads running towards the same;

drive means for driving said winding bobbin;

a thread guide arranged substantially coaxially with respect to and at a distance from said donning mandrel;

means for reducing the angle of a thread extending between said delivery bobbin and said thread guide;

a tube provided for the delivery bobbin;

an extension having an end and forming an axial prolongation attached to said tube of said delivery bobbin; and said thread being deflectable at said extension so as to form an angle of $<60°$ with an end face of said delivery bobbin.

16. The winding machine as defined in claim 15, wherein:

said extension forms a part of said donning mandrel at which there is mounted said delivery bobbin.

17. The winding machine as defined in claim 15, wherein:

said extension is inserted into said tube.

18. The winding machine as defined in claim 15, wherein:

said extension forms a prolongation of said tube.

19. The winding machine as defined in claim 15, further including:

an end member pivoted at said extension; and said end member guiding said thread.

20. The winding machine as defined in claim 19, wherein:

said end member prevents the thread when leaving said extension from running-off the extension by sliding around said end of said extension.

21. The winding machine as defined in claim 19, wherein:

said end member comprises a flexed part of said extension.

22. The winding machine as defined in claim 19, wherein:

said end member comprises a slotted disk mounted at said extension.

23. The winding machine as defined in claim 19, wherein:

said end member comprises a goose-neck end portion of said extension.

24. The winding machine as defined in claim 19, wherein:

said end member comprises a wire piece mounted at said extension.

25. The winding machine as defined in claim 15, further including:

a conically tapering section provided at said extension and disposed adjacent an end face of said delivery bobbin.

26. A method of winding-up a thread on a winding machine, doubling machine or the like comprising a winding bobbin, a delivery bobbin defining an upper edge and a guide eye arranged between the delivery bobbin and the winding bobbin, said method comprising the steps of:

passing said thread from said delivery bobbin through said guide eye towards said winding bobbin;

forming, during a normal winding-up operation, a thread balloon between said delivery bobbin and said guide eye and limiting said thread balloon by said guide eye; and forming, in the event of thread tension slackening, a thread reserve between said delivery bobbin and said winding bobbin by deflecting the thread at said upper edge of said delivery bobbin such that said thread is prevented from disengaging from an outer surface of said delivery bobbin due to friction at said upper edge, in order to prevent snarl formation.

* * * * *